US005524579A

United States Patent [19]

Eluchans

[11] Patent Number: 5,524,579

[45] Date of Patent: Jun. 11, 1996

[54] AIR COOLED ROTARY DISTRIBUTION VALVE FOR INTERNAL COMBUSTION ENGINE

[76] Inventor: Alejandro Eluchans, One Fitchburg St., Somerville, Mass. 02143

[21] Appl. No.: 331,378

[22] Filed: Oct. 28, 1994

[51] Int. Cl.[6] ..... F01L 7/02

[52] U.S. Cl. ..... 123/79 R; 123/59.1; 123/190.6; 123/190.8

[58] Field of Search ..... 123/79 R, 79 A, 123/80 R, 80 BA, 80 C, 52.1, 59.1, 59.3, 190.1, 190.12, 190.4, 190.5, 190.6, 190.8, 188.1, 188.2, 90.2, 90.31

[56] References Cited

U.S. PATENT DOCUMENTS

| | | | |
|---|---|---|---|
| 1,176,402 | 3/1916 | Reeves | 123/190.5 |
| 1,176,905 | 3/1916 | Jones | 123/190.6 |
| 1,311,200 | 7/1919 | Abell | 123/79 R |
| 1,380,435 | 6/1921 | Strebel | 123/59.1 |
| 1,402,616 | 1/1922 | Jackman et al. | 123/59.1 |
| 1,887,997 | 11/1932 | Cross | 123/190.8 |
| 1,951,759 | 3/1934 | Keister | 123/79 K |
| 3,183,661 | 5/1965 | Peterson | 123/59.1 |
| 5,315,969 | 5/1994 | MacMillan | 123/190.8 |
| 5,398,647 | 3/1995 | Rivera | 123/79 R |

FOREIGN PATENT DOCUMENTS

| | | | |
|---|---|---|---|
| 0875893 | 5/1953 | Germany | 123/190.8 |

*Primary Examiner* Marguerite Macy
*Attorney, Agent, or Firm* John M. Brandt

[57] ABSTRACT

A rotary distribution and air cooling valve for combustion and exhaust gases for an internal combustion engine consisting of a tube mounted in a bore within the engine head having a pair of opposed side ports and an internal barrier which acts as an air fan to both cool the valve site and channel the gases in and out of the engine in timed sequence. A plurality of grooves are disposed on the surface of the tube to provide a labyrinth fluid seal.

6 Claims, 4 Drawing Sheets

AIR COOLED ROTARY DISTRIBUTION VALVE FOR INTERNAL COMBUSTION ENGINE

BACKGROUND OF THE INVENTION

1. Field of the Invention

The invention relates to valve systems for controlling the passage of fluids in an internal combustion engine and more particularly relates to rotary air intake and combustion gas exhaust valves to be used in conjunction with compression and expansion popper valves.

2. Description of the Prior Art

Control of fluid flow within internal combustion engines is an essential and well known part of the operation of such engines. Generally a separate intake and exhaust valve of the cam operated popper type are provided for each engine cylinder. The function of these valves is to direct combustible fluid to the cylinder, seal the cylinder during compression in the cylinder by the piston and expansion after ignition, and to allow for the removal of the exhaust gas.

It has been recognized that the elimination of one of the poppet valves and the substitution of a rotary distribution valve for managing the flow of intake combustion gas and combusted exhaust gas will have the beneficial effect of reducing noise, wear, and the number of operating parts. See, for example, U.S. Pat. No. 1,311,200, Abell wherein a single cavity rotary distribution valve is disclosed; and U.S. Pat. No. 1,951,759, Keister, describing a dual cavity rotary distribution valve. Despite the substantial age of this technology as evidenced by the issue dates of the above named patents, rotary distribution valves have yet to find acceptance within the internal combustion engine industry. The practical problems associated with the use of these valves involve temperature control and lubrication and seal design.

In contrast to the prior art best known to the inventor, the invention described herein provides improved cooling of the immediate valve site and engine head, a simplified system of construction which eliminates many parts required in existing designs and a novel means of sealing which minimizes the mixing of intake and exhaust gases.

SUMMARY OF THE INVENTION

The invention may be summarized as a rotary distribution and cooling valve for combustion and exhaust gases for an internal combustion engine composed of an open ended cylinder or tube having a pair of opposed ports in the wall thereof and a barrier member disposed within the tube completely blocking communication between each tube end and each tube port. As will be further referred to the tube, barrier, and arrangement of ports constitute a fan. The tube is mounted in a bore in the engine head block such that fluid flow will intermittently occur between the valve ports and a passageway connected with one or more engine cylinders upon rotation of the tube.

Additionally, a plurality of turbulence creating grooves or strips are disposed on the surface of the outer wall of the tube which grooves are diagonally disposed to the longitudinal axis of the tube and communicate with the exterior of the engine head. The grooves taken as a whole constitute a labyrinth gas seal for preventing the mixing of intake and exhaust gases.

A single poppet valve is disposed in each cylinder to provide a seal during the compression of the combustion gas and expansion against the piston upon ignition.

The intake end of the tube provides the mounting bearing for the rotary valve while the exhaust end is free of mechanical contrast with the block.

In an operating cycle, air is drawn into the tube intake end by the fan action created by the barrier within the tube and forced through one of the tube ports into the passageway connected to an engine cylinder. The cylinder poppet valve is open allowing the injection of air into the engine cylinder. In a diesel engine, fuel is injected separately; in a standard engine, fuel is mixed with the air in a carburetor prior to entering the rotary valve.

The poppet valve then closes and remains closed while the piston moves to compress the combustion gas which at the appropriate moment ignites driving the piston downward. The popper valve then opens allowing the expulsion of the exhaust gas by the upward movement of the piston. The rotary valve is now so positioned that the opposite port is aligned to receive the exhaust gas from the cylinder passageway and propel it out the exhaust end of the tube through the fan action of the barrier.

Valve positioning, that is, timing of the popper and rotary valves, is accomplished in the case of the poppet valve by a cam and in the case of the rotary valve by the use of a timing belt, a feature resulting from the relatively cool intake tube end due to the fan action of the barrier.

Additionally, the invention contemplates the use of a single rotary valve to accommodate two engine cylinders placed side by side; an integral engine head rather than the gasketed head now universally employed; and the construction of an engine wherein the upper or head portion is cooled by air and the lower portion by water. The latter feature will allow a further reduction in complexity, for example, a smaller radiator, smaller water pump, and the like.

These and other features and advantages of the invention will become more clear from the description of the preferred embodiment and drawings which follows.

DESCRIPTION OF THE PREFERRED EMBODIMENT

The valve system described herein consists of two significant parts i.e. a popper valve and the rotary valve which constitutes the invention.

The poppet valve is preferably of the over-head camshaft type. The engine camshaft activates a single poppet valve per cylinder. The timing of the poppet valve is approximately 50 percent open and 50 percent closed for every turn of the camshaft and the camshaft rotates at half the speed of the crankshaft.

Figure 1:
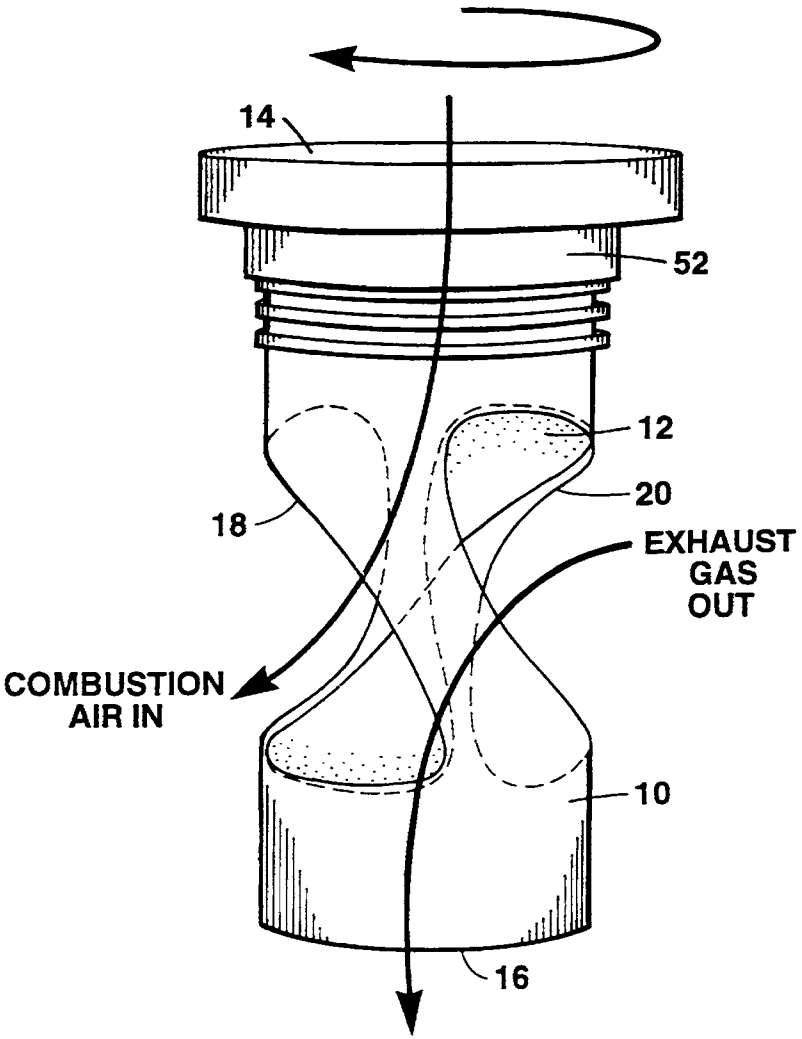
FIG. 1 is a perspective view of the preferred embodiment of the invention.

The rotary valve consists of a fan or tube 10 as shown in FIG. 1 and is disposed in a bore to be illustrated below. A barrier or propeller 12 is diagonally disposed inside the middle of the tube creating a barrier between the openings at both ends of the tube 14 and 16.

There are two holes 18 and 20 on the tube that are located approximately in the middle of the curved side or wall of the tube. These holes are positioned on opposite sides in order that propeller 12 forms a barrier between holes 18 and 20.

The purpose of this design which constitutes a cooling fan as well as a fluid distributor is that when the valve rotates, propeller 12 propels fluids from one end of the tube to one hole and at the same time propels fluids from the other hole to the other opening of the tube. That is, fluids entering hole or entrance port 14 will be propelled out of hole or exit port 18, and fluids entering hole or entrance port 20 will be propelled out of hole or exit port 16.

Figure 4:
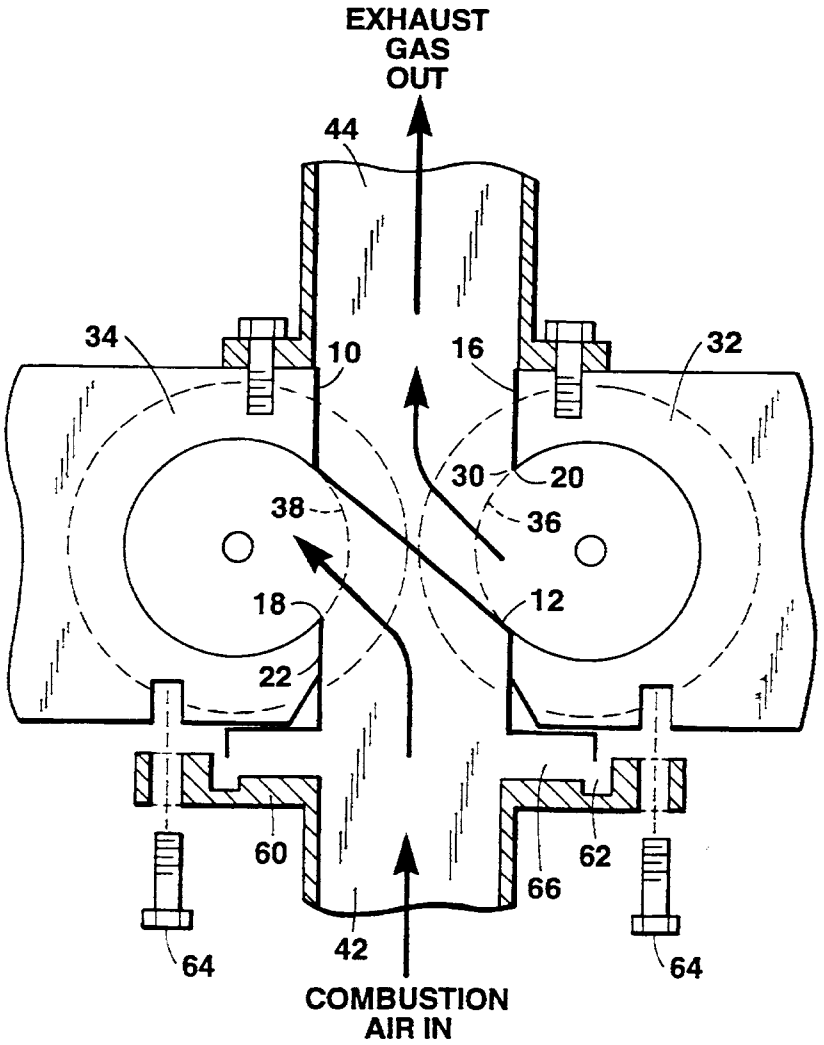
FIG. 4 is a cross sectional top view of the embodiment of FIG. 1 in an engine environment.
Figure 5:
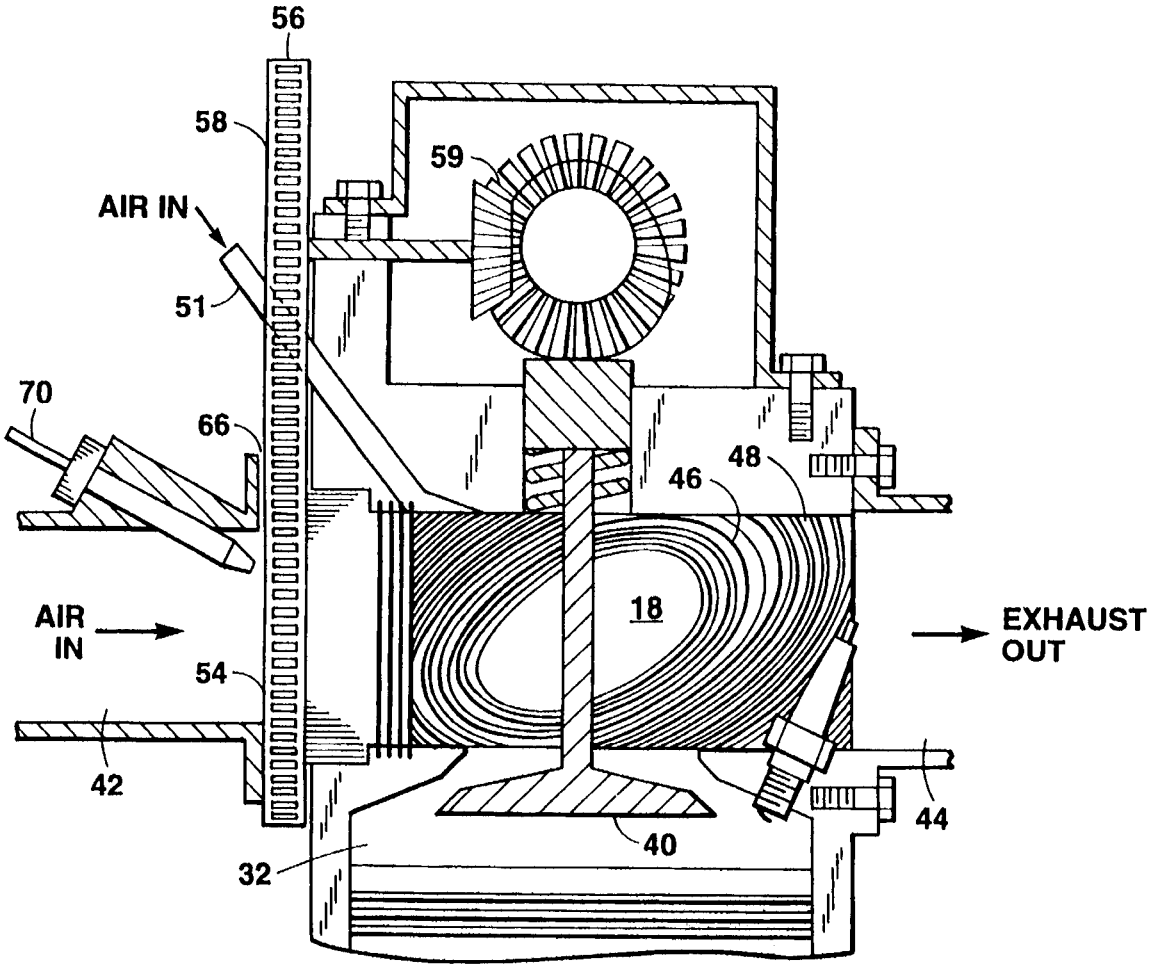
FIG. 5 is a cross sectional side view of the embodiment of FIG. 1 in an engine environment.
Figure 6:
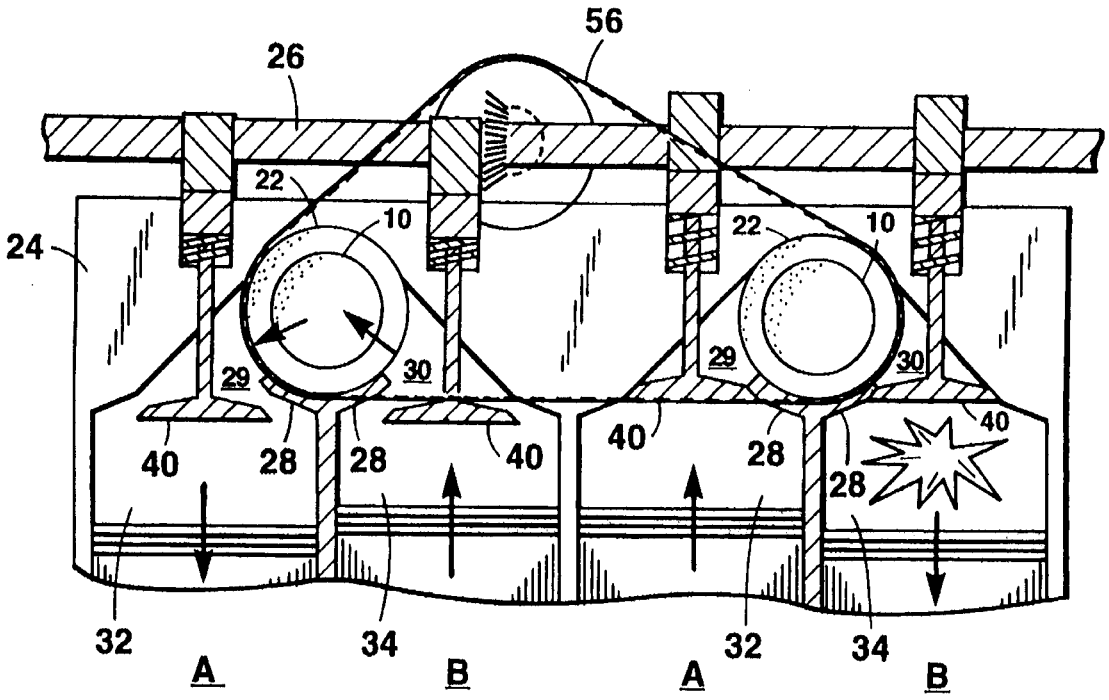
FIG. 6 is a cross sectional front view of the embodiment of FIG. 1 in an engine environment illustrating engine operation.

In an engine as illustrated in FIGS. 4, 5, and 6, tube 10 is positioned inside bore 22 within the engine cylinder head 24 at a perpendicular orientation to camshaft 26. Fan or tube 10 is further positioned between cylinder top 28 and camshaft 26.

Bore 22 that accommodates tube 10 is a cylinder-like opening across head 24 of the engine. Approximately at the center of bore 22 there are two ducts 29 and 30 that connect bore 22 to two combustion chambers 32 and 34 on both sides of bore 22. Ducts 29 and 30 align to holes 18 and 20 on fan 10. Duct ends 36 and 38 that align with holes 18 and 20 are smaller in diameter than holes 18 and 20 in order to maximize the time of fluid exchange between fan 10 and 29 and 30.

Referring to FIG. 5 popper valve 40 is positioned next to fan 10 in order to open out to holes 18 and 20 through ducts 28 and 30. When fan 10 rotates, each combustion chamber opens intermittently to the openings on both ends of the bore and fan as shown in FIG. 4.

In this manner, the combustion chamber is alternately connected to an air intake port 42 and engine exhaust port 44.

The fan rotates at the same speed as the engine. Consequently, on every engine turn, the bore opens to exhaust and then opens to intake.

Figure 2:
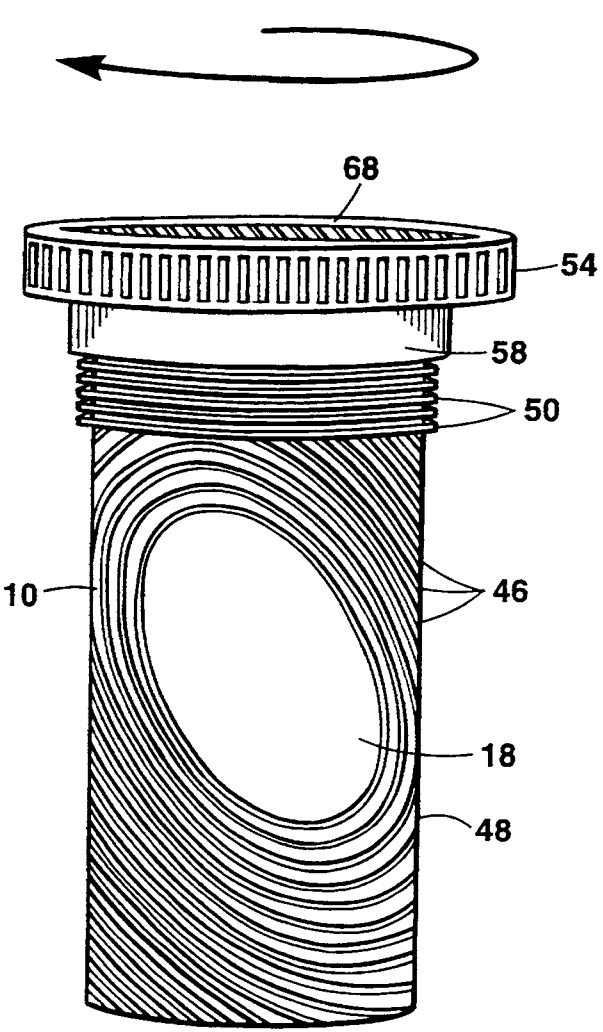
FIG. 2 is a side view of the embodiment of FIG. 1 showing additional structure.
Figure 3:
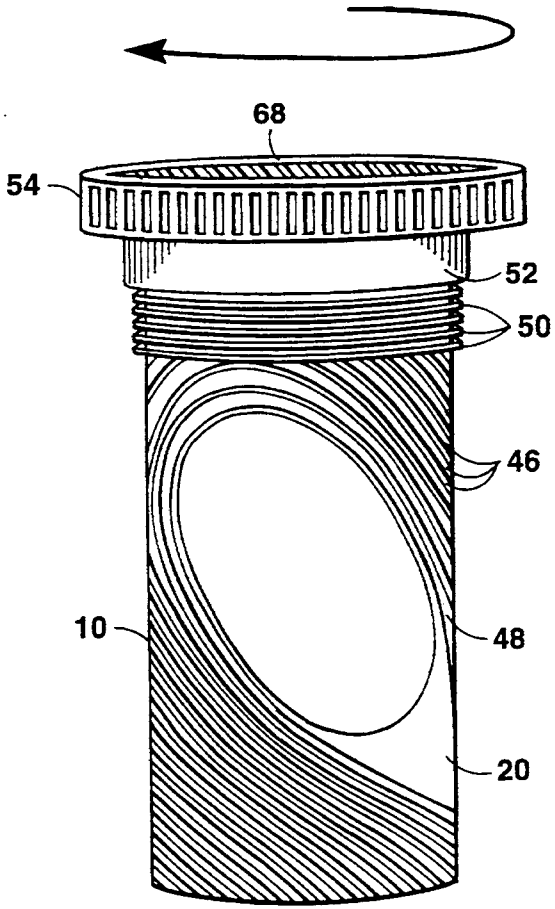
FIG. 3 is an alternative embodiment of the view of FIG. 2.

Referring next to FIG. 2, a labyrinth seal consisting of a series of strips 46 that form orifices or grooves is present around the outside surface 48 covering fan 10. Strips 46 run around intake hole 18 and as shown in FIG. 3 exhaust hole 20. The strips are positioned on an angle similar to a windsack or visco seal allowing the strips to push or pump trapped gases along the fan's outer surface toward the exhaust end of the bore. A stepped labyrinth seal consisting of a series of strips 50 may also be placed around the intake opening of fan 40 minimizing exhaust gas flow to the intake manifold.

Functionally, the labyrinth seal forms orifices that throttle the flow of gases and create high fluid velocities at the constriction. The fluid then expands into the chamber beyond the constriction. Turbulence results, and a pressure drop occurs. The labyrinth seal minimizes the flow of gases around the fan's outer surface in order to prevent the excessive mixing of the exhaust and intake gases. Labyrinth strips 46 further provide cooling to the fan by allowing airto flow between the fan and the bore, and from intake end 42 of the bore to exhaust end of the bore 44. A small clearance between the teeth of the labyrinth strips and the bore should be provided. Optionally, for additionally cooling, an auxiliary air supply from duct 51 may be fed to this clearance by natural suction or by a pump not shown.

A bearing 52 is placed around intake opening 14. An external pulley 54 mounted against and atop bearing 52 provides for rotating power. An external time belt 56 as shown in FIG. 6 powers a single valve or multiple valves as in the case of a multiple cylinder engine. Pulley 58 that powers belt 56 is connected to over head camshaft 26 by means of a gear system. Engine intake manifold 60 provides cavity 62 to accommodate belt 56.

Intake manifold 60 is fastened to engine head 24 with bolts 64 located between intake openings 42 of engine head 24.

Additionally, an air seal similar to the labyrinth seal explained above may be created by a small clearance 66 in the fit between intake manifold 60 and spiral grooves 68 on the pulley's side face as shown in FIGS. 2 and 3. Spiral grooves 68 push air out of the intake duct 42 and compensate for pressure differences between the duct and ambient pressure.

As will be seen, the removal of intake manifold 60 provides easy access for installation and removal of tubes or fans 10. An intake manifold gasket may thus be eliminated.

As shown in FIGS. 4 and 6, a single fan interacts with two engine cylinders In this case the fan's surface holes open to two cylinders through poppet valve 40. Consequently when cylinder A is in intake, cylinder B is exhausting; followed by cylinder A in compression and cylinder B in intake; followed by cylinder A in expansion and cylinder B in compression; followed by cylinder A in exhaust and cylinder B in expansion. This design reduces overall the numbers of parts and greatly simplifies the manifolds.

Because one fan interacts with two cylinders simultaneously and two cylinders share the same intake and exhaust ducts in the engine head, only one timed injector 70 is required for every two cylinders. When cylinder A is in intake, cylinder B is in exhaust. Consequently, because the next cycle of cylinder B is intake, a single timed injector provides fuel in one or two sprays to cylinders A and B.

Figure 7:
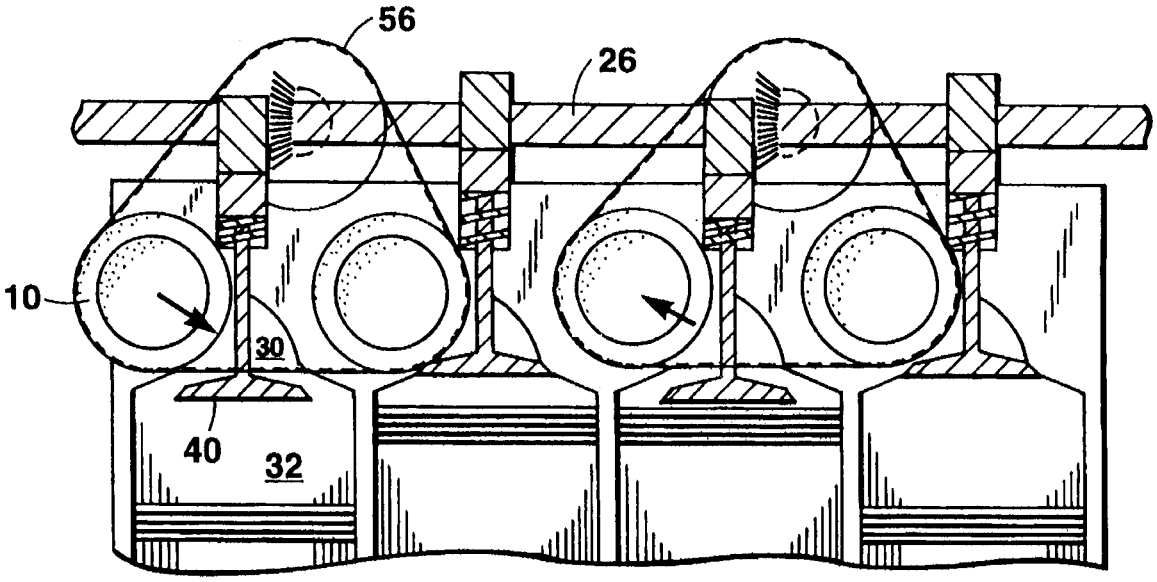
FIG. 7 is a cross sectional front view of the embodiment of FIG. 1 in an alternative engine environment.

FIG. 7 illustrates the use of the invention in an engine in which one fan is used for each cylinder rather than two as described above.

The timing cycle will be obvious to those skilled in the art. Different light materials in the aluminum alloy family may be used in the design of the fan's labyrinth outer surface. An insulating and refracting material such as ceramic may be used in the internal surface and propeller for temperature control enabling a reduction of head transfer to the engine head.

As variations of the above disclosed structure may be made by those skilled in the art, the invention is hereby defined by the following claims.

What is claimed is:

1. In an internal combustion engine comprising in combination:

(a) a cylinder having an intake and exhaust port;

(b) a reciprocating piston disposed within said cylinder;

(c) a poppet valve disposed within said cylinder arranged to open and close said port in timed sequence to admit and expel combustion and exhaust fluids;

(d) an engine head having an intake port and an exhaust port, and a bore arranged to provide communication between said ports and said cylinder intake and exhaust port; and (c) timing apparatus disposed within said engine head and connected to said poppet valve for sequentially opening and closing said valve, the speed of said timing apparatus arranged to be dependent upon the speed of said engine; the improvement which comprises:

1. a rotatable tube disposed within said bore, one end of said tube arranged to communicate with said engine head intake port and the other end of said tube arranged to communicate with said engine head exhaust port; said tube further having a pair of opposed tube ports disposed in the surface thereof and arranged to alternately communicate with said cylinder port upon rotation of said tube;

2. tube drive means attached to said tube operatively connected to said timing means for rotating said tube to provide sequential timed alignment of said tube ports and said cylinder port;

3. a barrier disposed within said tube transverse said tube ports, said barrier arranged to provide fluid connection between said engine head intake port and one of said tube ports and to provide fluid connection between said engine head exhaust port and the other of said tube ports whereby upon rotation of said tube, fluid connection is alternatively made between said engine head intake port and said cylinder port; and said engine head exhaust port and said cylinder port; and 4. said tube further having a plurality of spaced apart diagonal grooves disposed on the exterior surface of said tube, said grooves forming an acute angle with the longitudinal axis of said tube, said grooves functioning to propel gas about the tubes outer surface from said intake port to said exhaust port.

2. The apparatus of claim 1 wherein said tube is arranged to rotate at the same speed as the speed of said engine.

3. The apparatus of claim 1 wherein said barrier has opposing curved surfaces in the shape of a propeller.

4. The apparatus of claim 1 wherein said tube drive means comprises a pulley attached to said tube and a belt communicating between said pulley and said timing means.

5. The apparatus of claim 1 further including a bearing surface disposed on the outer surface of said tube positioned at the intake port end of said tube, said bearing surface arranged to rotate within said engine bore.

6. The apparatus of claim 1 wherein said bearing surface has disposed thereon a plurality of alternating annular spaces to form a labyrinth fluid seal between said bearing surface and said bore.

* * * * *